US005510153A

United States Patent [19]

Lilienthal, II et al.

[11] Patent Number: 5,510,153

[45] Date of Patent: Apr. 23, 1996

[54] METHOD FOR ENCAPSULATING ELECTRONIC CONDUCTORS

[75] Inventors: Peter F. Lilienthal, II, Princeton, N.J.; Ivan Pawlenko, Holland, Pa.; Ching-Ping Wong, Lawrenceville, N.J.

[73] Assignee: AT&T IPM Corporation, Coral Cables, Fla.

[21] Appl. No.: 102,178

[22] Filed: Aug. 4, 1993

[51] Int. Cl.[6] ..... B05D 7/20; H01B 7/02

[52] U.S. Cl. ..... 427/515; 174/110 S; 174/114 R; 174/115; 174/251; 427/120; 439/936

[58] Field of Search ..... 427/515, 120, 427/219; 439/936; 174/110 R, 114 R, 115, 251; 522/148

[56] References Cited

U.S. PATENT DOCUMENTS

| | | | |
|---|---|---|---|
| 3,175,935 | 3/1965 | Vanstrum | 428/142 |
| 4,008,113 | 2/1977 | Glander et al. | 174/110 S X |
| 4,048,356 | 9/1977 | Bakos et al. | 427/515 X |
| 4,770,641 | 9/1988 | Rowlette | 439/86 |
| 4,846,721 | 7/1989 | Debruycker et al. | 439/411 |
| 4,874,326 | 10/1989 | Marolda, Jr. | 439/936 X |
| 4,954,098 | 9/1990 | Hollingsworth et al. | 439/936 X |
| 5,063,102 | 11/1991 | Lee et aL. | 428/209 |
| 5,082,873 | 1/1992 | Liles | 522/86 |
| 5,090,919 | 2/1992 | Tsuji | 439/936 X |
| 5,162,397 | 11/1992 | Descamps et al. | 523/219 |
| 5,213,864 | 5/1993 | Wong | 428/76 |
| 5,246,383 | 9/1993 | Shimirak et al. | 439/936 X |
| 5,273,449 | 12/1993 | Mattis et al. | 439/936 X |
| 5,294,464 | 3/1994 | Geisler et al. | 427/515 X |

OTHER PUBLICATIONS

Jacques Thuery, "Microwaves and Matter," Chapter I.3 in Microwaves: Industrial, Scientific, and Medical Applications, edited by Edward H. Grant, King's College London, (Artech House 1992) pp. 102–106.

Dr. Charles Y–C Lee, "Microwave Processing of Polymers and Polymeric Composites," *in Microwave Processing of Materials II,* edited by W. B. Snyder, Jr. et al., (Materials Research Society Symposium Proceedings, vol. 189, 1991) pp. 411–412.

"Electromagnetic Processing of Polymers: I. Basic Concepts and Molecular Design of the Macromolecules," J. C. Hedrick et al., *Materials Research Society Symposium Proceedings,* vol. 189, 1991, pp. 421–430.

*Primary Examiner*—Richard D. Lovering
*Attorney, Agent, or Firm*—Roderick B. Anderson

[57] ABSTRACT

Glass particles (14) are mixed within an uncured silicone resin (13). The fluid uncured resin is placed in a portion of a terminal block (11) and cured to form a gel (13') by subjecting it to microwaves in a microwave oven (22). Conductors (25, 26) to be interconnected are next inserted into the cured silicone gel and interconnected. The cured gel containing the glass particles thereafter constitutes a dependable insulator for the conductors, particularly the portions of the conductors that are interconnected.

11 Claims, 1 Drawing Sheet

41

METHOD FOR ENCAPSULATING ELECTRONIC CONDUCTORS

TECHNICAL FIELD

This invention relates to methods for curing polymers and, more particularly, to methods for curing silicone resins used to encapsulate conductors.

BACKGROUND OF THE INVENTION

The Wong, U.S. Pat. No. 5,213,864, is an example of the literature describing the use of heat-cured silicone resin for encapsulating integrated circuits. Silicone resin can also be used for encapsulating conductor interconnections in terminal blocks, but the volume required is significantly greater than that for encapsulating integrated circuits, which increases the time needed for heat curing. The time required for curing the insulative resin therefore significantly increases the cost of making terminal blocks by this method.

Accordingly, there is a long-felt need in the industry for methods to reduce the time needed for curing polymers, particularly silicone resins used for encapsulating conductive interconnections.

SUMMARY OF THE INVENTION

In accordance with one embodiment of the invention, glass particles are mixed within an uncured silicone resin. The uncured resin is placed in a portion of a terminal block and cured by subjecting it to microwaves in a microwave oven. Thereafter, conductors to be interconnected are inserted into the cured silicone gel and interconnected. The cured gel containing the glass particles thereafter constitutes a dependable insulator for the conductors, particularly the portion of the conductors that are interconnected.

In the absence of the glass particles, silicone resin cannot be cured by subjecting it to microwaves because it is substantially transparent to microwaves. The glass particles, however, become heated on exposure to the microwaves, thereby supplying the heat required for curing the silicone resin. With this feature, the time required for cure of the silicone is significantly reduced.

These and other objects, features and benefits of the invention will be better understood from a consideration of the following detailed description taken in conjunction with the accompanying drawing.

DETAILED DESCRIPTION

Figure 1:
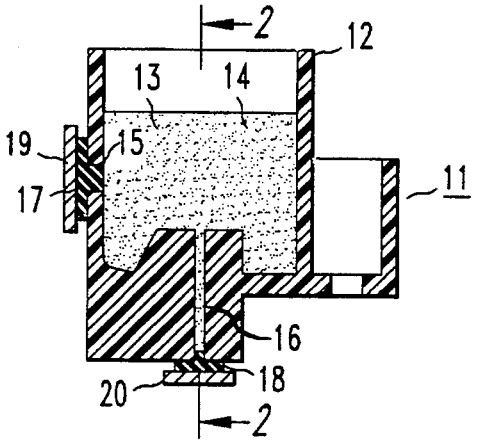
FIG. 1 is a sectional view of part of a partially completed terminal block in accordance with an illustrative embodiment of the invention.
Figure 2:
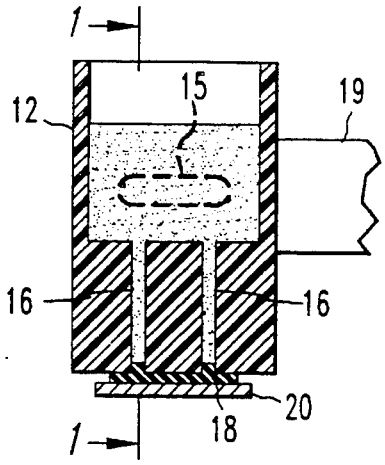
FIG. 2 is a view taken along lines 2—2 of FIG. 1.

The drawings are not necessarily to scale and have been simplified to aid in clarity of exposition. Referring now to FIG. 1, there is shown a terminal block 11 comprising a container 12 for holding a quantity of uncured silicone resin 13. In accordance with the invention, a quantity of glass particles 14 have been distributed within the fluid resin. The container 13 includes windows 15 and 16 which are covered by rubber plug members 17 and 18, which in rum are secured in place by clamp members 19 and 20.

Figure 3:
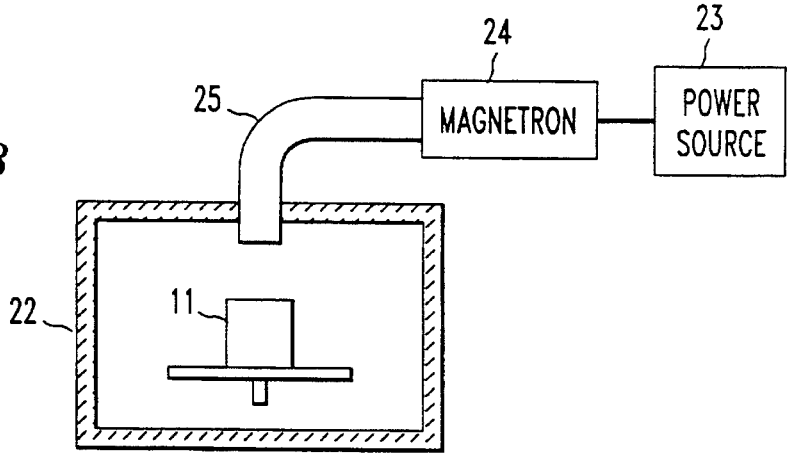
FIG. 3 is a schematic view of a microwave oven used for treating the terminal block portion of FIG. 1.

As shown schematically in FIG. 3, the terminal block 11 containing the uncured silicone resin is next placed within a microwave oven 22. The microwave oven is of a conventional type comprising a power source 23, a magnetron 24 and a waveguide 25. The magnetron generates microwaves which are introduced into the oven by the waveguide and permeate the terminal block 11 and the uncured silicone that it contains. Ordinarily, silicone resin must be heated in a conventional oven to cure it, that is, to harden it and transform it from a viscous liquid to a stable gel. This is because such resin is substantially transparent to microwaves. However, with the glass particles 14 distributed within the resin, the bulk of the resin heats sufficiently to cure it in a much shorter time than would be required by the normal method of heating it in a conventional oven.

Figure 4:
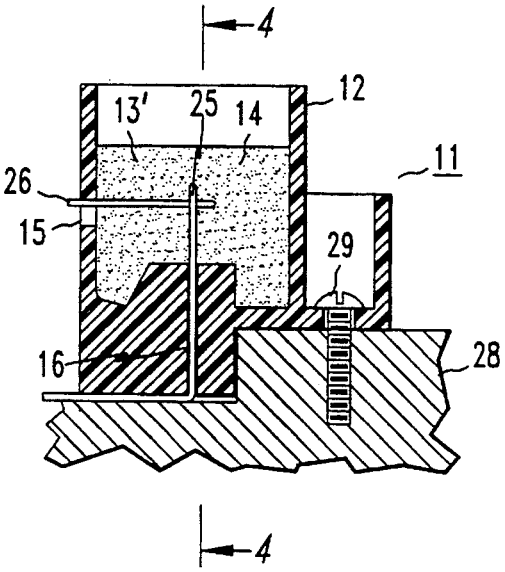
FIG. 4 is a sectional view of part of the terminal block of FIG. 1 at a subsequent stage of its fabrication.
Figure 5:
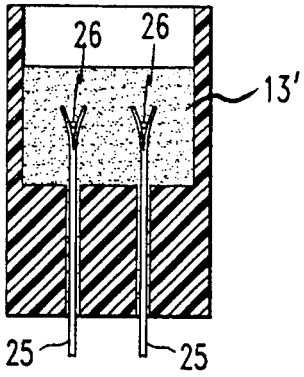
FIG. 5 is a view taken along lines 4—4 of FIG. 3.

Referring to FIG. 4, after the uncured resin has been cured to form a resin gel 13', the rubber plug members 17 and 18 are removed from windows 15 and 16. Because the silicone gel 13' has solidified, it does not flow through the uncovered windows 15 and 16. As is known, silicone gel has a soft consistency, which permits one to insert into it conductors 25 and 26 for interconnection. As shown in FIG. 5, conductors 26 each have on one end a pair of prongs that form a V. Conductors 26 are inserted through window 15 so as to fit within the vertex of the V.

Referring again to FIG. 4, conductors 16 are fixed to a substrate 28. The terminal block is likewise fixed to substrate 28 by a screw 29. Screwing the screw 29 forces the entire terminal block 11 in a downward direction, which causes the top of window 15 to exert a downward force on conductor 26. This, in turn, forces the conductors 26 into the vertices of the V-shaped conductors as shown in FIG. 5. In practice, the prongs of conductors 16 have sharp edges that cut an insulation layer of conductors 26 to insure contact between the conductors 25 and the conductors 26. Certain plastic reinforcement members also bear on conductors 26 which, for purposes of clarity, have not been shown.

After assembly of the terminal block as shown in FIGS. 4 and 5, the silicone gel 13' constitutes a dependable protective encapsulant for the interconnections of conductors 25 and 26. After the conductors have been inserted, the silicone gel 13' is sufficiently fluid to flow about the conductors to seal them from the external environment. In particular, we have found that such terminal blocks after assembly can be immersed in water and used for an extended time without any of the water reaching the locations of contact of conductors 25 and 26.

The silicone gels that were used for our experiments were Dow Corning 527, available from the Dow Corning Company of Midland, Mich., GE 6196, available from the General Electric Company of Waterford, N.Y. and Shin-etsu 1052, available from the Shin-etsu Company of Torrance, Calif. All of these gels were siloxanes having vinyl terminations and hydride terminations in the ratio of 1:1. Silicone gel is most typically a form of polydimethylsiloxane, although it can include such related compounds as polymethylsiloxane, polymethylphenylsiloxane and others as are known in the art. The glass particles 14 that were used were glass spheres having diameters of one hundred forty to two hundred seventy micrometers, available from Potters Industries, Hasbrouck Heights, N.J.

We also tried silver coated glass spheres and found them to be equally effective. We found that generally about ten percent by weight of the glass spheres or 2.5 percent by weight of silver coated glass spheres were optimum for speeding the silicone gel cure process. The curing time varied between ten minutes and twenty-eight minutes, which constituted a significant improvement over the time needed for curing in a conventional oven. Typically, the silicone gel curing time was reduced by thirty-nine percent using microwave curing as compared to conventional oven baking. The microwave oven used was a Model MD581, available from the CEM Company of Indian Trail, N.C. It was operated at one hundred percent power, and had a microwave frequency of 2.45 gigahertz.

It is desirable that, when the resin is being cured, the glass particles be dispersed as uniformly as possible to insure uniform heating. Uncured silicone gel is sufficiently thick that after mixing, they will remain substantially uniformly dispersed if the curing is done reasonably promptly. Of course, if the uncured silicone is allowed to stand in the terminal blocks for a sufficient length of time, the glass particles will eventually, and undesirably, settle to the bottom. Conventional mixing is used to distribute the particles, after which the mixture is injected into the container of the terminal block.

Silicone resin is a polymer which is polymerized or crosslinked during cure. That is, uncured silicone resin is a polymer precursor. It contains a platinum catalyst for speeding up the cure, and this platinum catalyst is contained in the silicones that were described above. Other polymers are also cured by baking and some can be cured by microwave irradiation. Others, as with silicone resin, cannot be cured by mere exposure to microwave radiation because they are essentially transparent to the microwaves.

The molecular characteristics required for heating by microwaves is described, for example, in the book, "Microwaves: Industrial, Scientific, and Medical Application," Jacques Thuery, *Artech House*, Norwood, Mass., 1992, pp. 103–106. Generally, such material must have a significant dipole moment which is capable of being excited by the applied microwave field. Water and similar compounds containing hydroxy (OH) reactive groups are known to have a relatively high dipole moment capable of such excitation with a resulting generation of heat.

Glass inherently has a high density of surface hydroxy groups and is therefore absorptive of microwave energy with the resulting generation of heat. The glass particles that we used in practicing the invention were of conventional soda lime glass, although other glasses such as boro-silicate glass also inherently have a high density of surface hydroxy groups. This characteristic remains when the particles are coated with silver as described before.

Other polymers that are normally transparent to microwaves may likewise be cured as described above. If in their uncured form they are sufficiently viscous that glass particles can be distributed throughout their volume, there is no reason why such particles could not generate the heat required for their cure. Particles other than glass having a significant dipole moment could alternatively be used.

One reason for using silicone gel as shown in FIG. 4 is that it is optically transparent and thus an operator can observe the interconnection of conductors 25 and 26. The dispersal of small glass particles as described does not detract from this transparency.

The use of silicone resin for encapsulating conductors is of course only illustrative of one use of the invention. Silicone resins are commonly used for encapsulating electronic devices and the invention may be useful in such circumstances for speeding the cure process. The presence of the glass particles appears to have no effect on the electrical insulative qualities of the material.

The various embodiments described are intended to be merely illustrative of the inventive concepts. For example, in any practical production, a multiplicity of terminal blocks of FIG. 3 would be simultaneously cured in a microwave oven. Various other embodiments and modifications may be made by those skilled in the art without departing from the spirit and scope of the invention.

We claim:

1. A method for encapsulating electronic conductors comprising the steps of:

mixing glass particles in an uncured silicone resin;

curing the silicone resin;

the cured silicone resin encasing electrical conductors to be electrically insulated;

the curing step comprising the step of transmitting microwaves into the uncured resin, thereby to heat the resin as is required for cure.

2. The method of claim 1 wherein:

the uncured resin is sufficiently thick that the glass particles can be suspended therein for a predetermined period of time;

the uncured resin with the glass particles therein is contained within a container;

the glass particles are substantially uniformly distributed within the volume of the resin;

and the resin in the container is cured before passage of said predetermined period of time, whereby the glass particles remain substantially uniformly distributed in the cured resin.

3. The method of claim 1 wherein:

the silicone resin is of a type which, after cure, has a gel consistency;

and after the cure, first and second conductors are inserted into the resin so as to make electrical contact.

4. The method of claim 3 wherein:

a first end of the first conductor comprises two prongs arranged in a V-shape;

and an end of the second conductor is wedged between the two prongs.

5. The method of claim 4 wherein:

the container includes first and second windows which are covered when the uncured resin is put in the container;

and after the resin has been cured, the windows are uncovered, and a first conductor is inserted through one window and a second conductor is inserted through another window.

6. The method of claim 1 wherein:

the glass particles are coated with a metal.

7. The method of claim 6 wherein:

the metal is silver.

8. The method of claim 1 wherein:

the weight of the glass particles constitutes about ten percent by weight of the mixture.

9. The method of claim 1 wherein:

the glass particles are coated with silver;

and the weight of the coated glass particles is about 2.5 percent by weight of the total mixture.

10. A method for making an electrical insulator comprising the steps of:

mixing glass particles with an uncured insulative silicone resin, which resin is substantially transparent to microwaves of a predetermined frequency;

said glass particles having a high dipole moment;

with said particles being dispersed therein, subjecting the uncured resin to microwave radiation of said predetermined frequency, said radiation causing said glass particles to generate sufficient heat to cure said resin;

prior to cure, encasing an electronic device with said silicone resin, whereby the electronic device is encapsulated by the cured silicone resin;

said cured resin being substantially electrically insulative.

11. The method of claim 10 wherein:

the electronic device constitutes an electrical interconnection which is insulated by said cured resin.

* * * * *